US007240984B2

(12) United States Patent
Kayanaka

(10) Patent No.: US 7,240,984 B2
(45) Date of Patent: Jul. 10, 2007

(54) INKJET IMAGING DEVICE AND METHOD OF CONTROLLING THE SAME

(75) Inventor: Yoshihisa Kayanaka, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 392 days.

(21) Appl. No.: 10/951,699

(22) Filed: Sep. 29, 2004

(65) Prior Publication Data

US 2005/0068364 A1 Mar. 31, 2005

(30) Foreign Application Priority Data

Sep. 30, 2003 (JP) ..... 2003-341446

(51) Int. Cl.
*B41J 2/165* (2006.01)

(52) U.S. Cl. ..... 347/23; 347/29; 347/30; 347/32; 347/33; 347/35

(58) Field of Classification Search ..... 347/22–35
See application file for complete search history.

(56) References Cited

U.S. PATENT DOCUMENTS 6,176,564 B1 * 1/2001 Katayama ..... 347/23
6,318,834 B1 * 11/2001 Otsuka et al. ..... 347/23
6,595,616 B2 * 7/2003 Takahashi et al. ..... 347/23
2002/0005874 A1 1/2002 Imai et al.

FOREIGN PATENT DOCUMENTS

JP A-2002-036594 2/2002

* cited by examiner

*Primary Examiner*—Shih-Wen Hsieh
(74) *Attorney, Agent, or Firm*—Oliff & Berridge, PLC

(57) ABSTRACT

An inkjet imaging device is provide with a recording head that ejects ink toward a recording medium, a maintenance system that performs a recovery procedure consisting of a plurality of operations which include (1) a purging operation to remove ink from the recording head and (2) a wiping operation to wipe out the ink adhered oh a nozzle surface of the recording head after the purging operation is executed, a determining system that determines whether a currently executed operation of the recovery procedure can be interrupted when interruption of the currently executed recovery procedure is instructed, and an interrupting system that interrupts the recovery procedure when the determining system determines that the currently executed operation of the recovery procedure can be interrupted.

20 Claims, 10 Drawing Sheets

INKJET IMAGING DEVICE AND METHOD OF CONTROLLING THE SAME

BACKGROUND OF THE INVENTION

The present invention relates to an inkjet imaging device, capable of performing a recovery (maintenance) procedure that improves/recovers an ink ejecting condition of a recording head of the inkjet imaging device. The invention also relates to a method of controlling such an inkjet imaging device.

Conventionally, as an inkjet imaging device that ejects ink to recording medium such as a sheet of paper to form an image thereon, an inkjet printer is known. The inkjet printer typically includes a recording head unit which is provided with one or more recording heads and exchangeable ink cartridges for accommodating ink. The ink is supplied from the ink cartridge to the recording head, which selectively ejects the ink from a plurality of ink ejecting nozzles to form an image on the recording medium.

In the inkjet printer of the above type, when bubbles and/or foreign bodies reside inside an ink passage of the recording head, ejection of the ink may be blocked thereby, which deteriorates quality of the formed image.

A conventional inkjet printer is generally configured such that a recovery (maintenance) procedure for the recording head is executed when a user operates a predetermined switch and/or a predetermined condition is met. The maintenance procedure is for executing a purging operation, in which, a suction cap is placed on the nozzle surface and causes a negative pressure inside the suction cap using a suction pump, thereby the ink suctioned from the recording head is discharged outside the inkjet printer via the suction cap.

In the inkjet printer configured to execute such a maintenance procedure, in order to remove the ink adhered to the nozzle surface during the purging operation, a wiping operation and a flushing operation are further executed.

When the wiping operation is executed, a wiping member for removing (wiping out) the ink adhered onto the recording head is abut on the nozzle surface, while the recording head is moved with respect to the wiping member, thereby the nozzle surface of the recording head is wiped out.

When the wiping operation is executed, different color inks may be mixed among the nozzles for different colors. Therefore, the flushing operation for removing the mixed ink by ejecting the same is generally executed subsequent to the wiping operation. An example of such a sequence is disclosed in U.S. patent application Publication Ser. No. US 2002/000584 A1, teachings of which are incorporated herein by reference.

The inkjet printer operates in accordance with a predetermined sequence including a plurality of operation steps including the purging, wiping and flushing operations.

When the inkjet printer operates in accordance with a predetermined sequence to perform the maintenance procedure, if the maintenance procedure is forcibly stopped as, for example, a cancellation thereof is instructed by an operator, a problem as described below may arise. That is, when the sequence currently executed is interrupted during the maintenance procedure, the nozzle surface of the inkjet head is exposed to outside with the wet ink carrying thereon. When a print job is executed thereafter, an image may be blurred or faded. In order to avoid such a condition, some conventional inkjet printers are configured not to acquire the canceling instruction of the operator during the maintenance procedure. In such a configuration, since the maintenance procedure cannot be interrupted, the above problem is avoided.

Practically, however, the operator may intend to interrupt the maintenance procedure depending on a situation. In home-use inkjet printers or office-use ones, a time period for the maintenance procedure is relatively short. Accordingly, even though the maintenance procedure cannot be cancelled, the operator can wait for completion of the maintenance procedure. For commercial use inkjet printers for printing images on fabric such as T-shirts, however, the time period required for a maintenance procedure is relatively long in comparison with that for the home-use ones. Therefore, if the maintenance procedure cannot be cancelled, it is not only inconvenient but also it imposes the operator to wait for a relatively long time until the completion of the maintenance procedure.

SUMMARY OF THE INVENTION

The present invention is advantageous in that an improved inkjet imaging device can be provided, which is configured such that the maintenance procedure can be interrupted without causing the problem described above.

According to an aspect of the invention, there is provided an inkjet imaging device, which is provide with a recording head that ejects ink toward a recording medium, a maintenance system that performs a recovery procedure consisting of a plurality of operations which include (1) a purging operation to remove ink from the recording head and (2) a wiping operation to wipe out the ink adhered on a nozzle surface of the recording head after the purging operation is executed, a determining system that determines whether a currently executed operation of the recovery procedure can be interrupted when interruption of the currently executed recovery procedure is instructed, and an interrupting system that interrupts the recovery procedure when the determining system determines that the currently executed operation of the recovery procedure can be interrupted.

Optionally, when the determining system determines that the currently executed operation cannot be interrupted, the interrupting system may allow the recovery procedure to continue until another operation, which can be interrupted, is executed.

In a particular case, the determining system may determine any operation from the purging operation to the wiping operation as an operation that cannot be interrupted.

Alternatively, the plurality of operations may further include (3) a flushing operation in which the ink in the recording head is discharged after the wiping operation is executed, and the determining system may determine any operation from the purging operation to the flushing operation as an operation that cannot be interrupted.

Further optionally, when the currently executed operation that cannot be interrupted is a predetermined operation, the predetermined operation may be executed in a different way in comparison with a case where the interruption of the currently executed recovery procedure is not instructed.

In a particular case, when the predetermined operation is executed in the different way, a time period necessary for completion of the predetermined operation is reduced.

Optionally, the predetermined operation can be the purging operation.

In this case, when the purging operation is executed in the different way, the purging operation may be stopped when a predetermined amount of ink is purged.

Further optionally, the determining system may determine whether each of the plurality of operations can be interrupted.

In a particular case, the determining system may include a plurality of flags each indicative of whether an operation can be interrupted, the plurality of flags being assigned to the plurality of operations included in the recovery procedure, respectively.

According to another aspect of the invention, there is provided a method of controlling an inkjet imaging device having a recording head that ejects ink toward a recording medium and a maintenance system that performs a recovery procedure consisting of a plurality of operations which include (1) a purging operation to remove ink from the recording head and (2) a wiping operation to wipe out the ink adhered on a nozzle surface of the recording head after the purging operation is executed, the method including the steps of determining whether a currently executed operation of the recovery procedure can be interrupted when interruption of the currently executed recovery procedure is instructed, and interrupting the recovery procedure when the determining step determines that the currently executed operation of the recovery procedure can be interrupted.

Optionally, when the determining step determines that the currently executed operation cannot be interrupted, the interrupting step may allow the recovery procedure to continue until another operation, which can be interrupted, is executed.

Further, the determining step may determine any operation from the purging operation to the wiping operation as an operation that cannot be interrupted.

Still optionally, the plurality of operations may further include (3) a flushing operation in which the ink in the recording head is discharged after the wiping operation is executed, and the determining step may determine any operation from the purging operation to the flushing operation as an operation that cannot be interrupted.

Further optionally, when the currently executed operation that cannot be interrupted is a predetermined operation, the predetermined operation may be executed in a different way in comparison with a case where the interruption of the currently executed recovery procedure is not instructed.

Further, the determining step may determine whether each of the plurality of operations can be interrupted.

In a particular case, the determining step may determine whether each of the plurality of operations can be interrupted based on a plurality of flags each indicative of whether an operation can be interrupted, the plurality of flags being assigned to the plurality of operations included in the recovery procedure, respectively.

According to a further aspect of the invention, there is provided a computer program product comprising computer readable instructions causing a computer to control an inkjet imaging device having a recording head that ejects ink toward a recording medium and a maintenance system that performs a recovery procedure consisting of a plurality of operations which include (1) a purging operation to remove ink from the recording head and (2) a wiping operation to wipe out the ink adhered on a nozzle surface of the recording head after the purging operation is executed, the computer program product including the instructions of determining whether a currently executed operation of the recovery procedure can be interrupted when interruption of the currently executed recovery procedure is instructed, and interrupting the recovery procedure when the determining step determines that the currently executed operation of the recovery procedure can be interrupted.

Optionally, the computer program product may further include an instruction of continuing the recovery procedure until another operation, which can be interrupted, is executed.

Further, each of the operations from the purging operation to the wiping operation may be defined as an operation that cannot be interrupted.

BRIEF DESCRIPTION OF THE ACCOMPANYING DRAWINGS

DETAILED DESCRIPTION OF THE EMBODIMENT

Hereafter, an embodiment according to the invention will be described with reference to the accompanying drawings. According to the embodiment, the inkjet printer is for printing images on fabric such as a T-shirt in accordance with image data input thereto.

Figure 1:
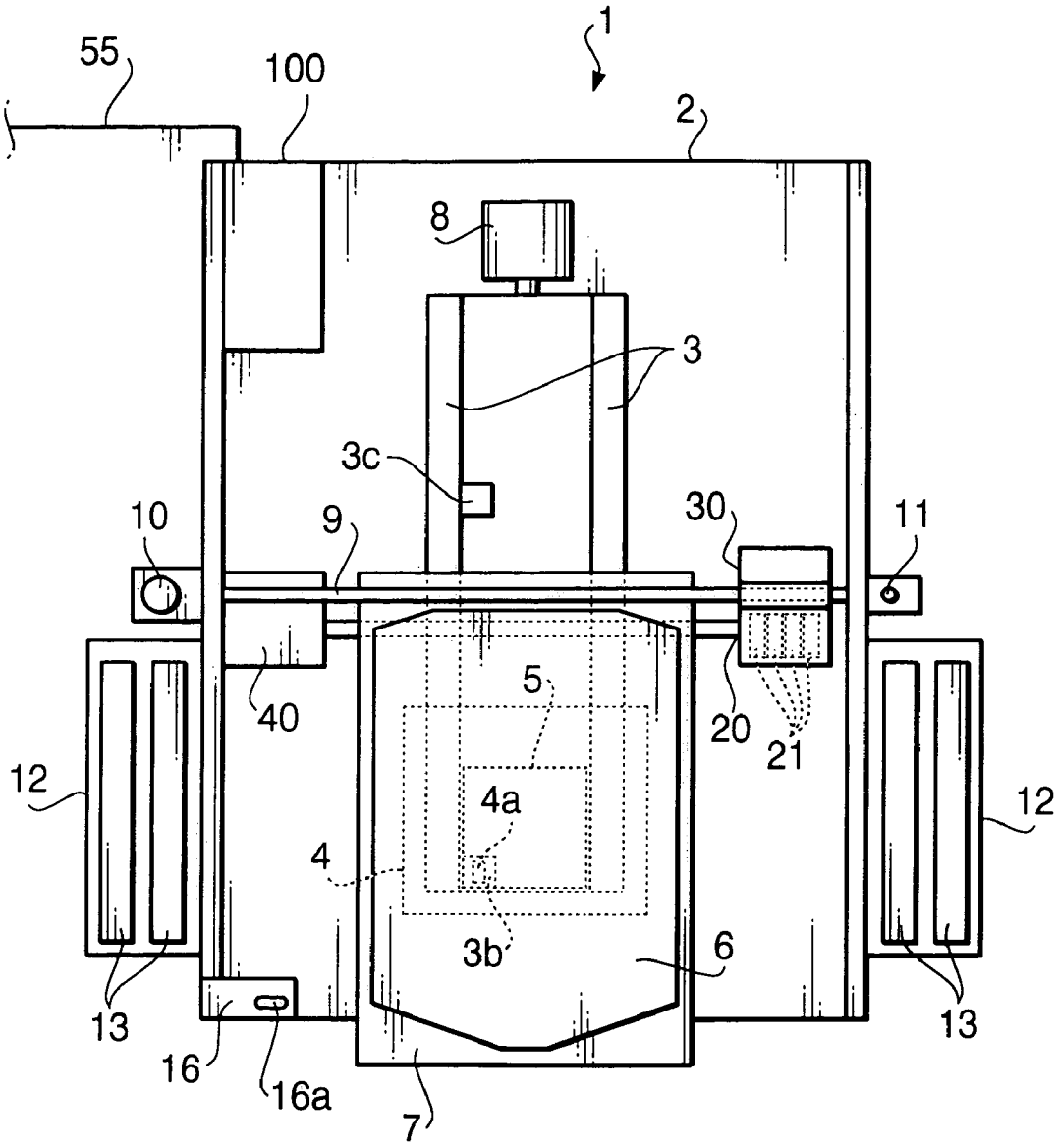
FIG. 1 is a plan view of an inkjet printer according to an embodiment of the invention.
Figure 2:
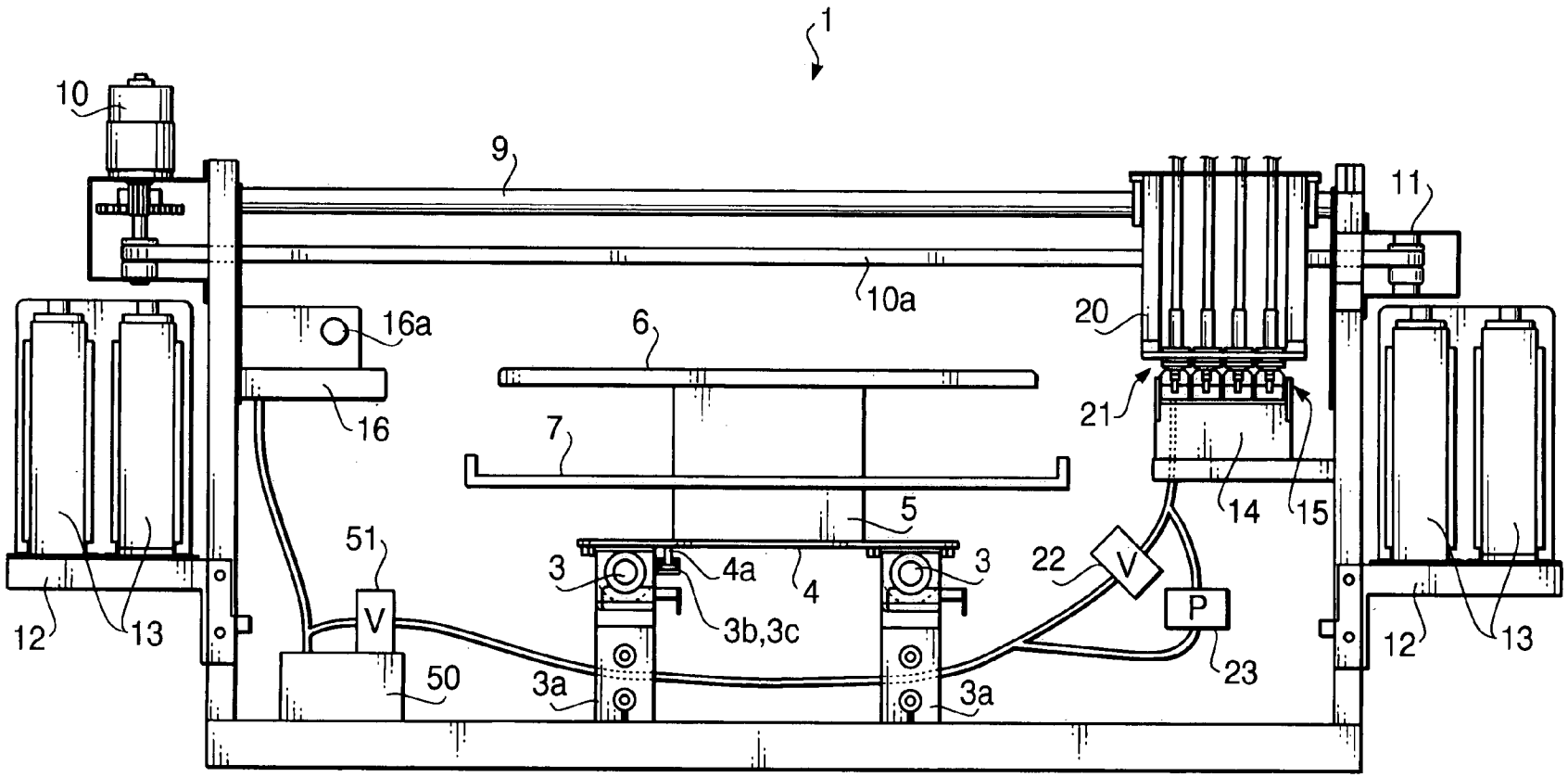
FIG. 2 is a front view of the inkjet printer according to the embodiment of the invention.

FIG. 1 is a plan view of an inkjet printer 1 according to an embodiment of the invention. FIG. 2 is a front view of the inkjet printer 1. A front side of the inkjet printer 1 is defined as a lower side on a plane of FIG. 1 and a front surface side of FIG. 2.

As shown in FIGS. 1 and 2, the inkjet printer 1 has a housing 2 having a form of a rectangular solid, whose longitudinal direction corresponds to an anteroposterior direction of the housing 2. At a substantially central position of the bottom surface of the housing 2, two guide rails 3 and 3 extending in the anteroposterior direction are arranged in parallel with each other. The two guide rails 3 and 3 are respectively supported on two bases 3*a* and 3*a* (see FIG. 2) which are formed on a bottom surface of the housing 2 to be raised in a vertical direction of the housing 2. On the tops of the two guide rails 3 and 3, a planar platen supporting table 4 is supported such that the platen supporting table 4 is slidable, guided by the guide rails 3 and 3, in the anteroposterior direction of the housing 2. At a substantially central portion of the platen supporting table 4, a supporting column 5 is provided. On a top surface of the supporting column 5, an exchangeable platen 6 is secured.

The exchangeable platen 6 is a plate member having a substantially rectangular shape viewed from the top, having longitudinal sides parallel with the anteroposterior direction of the housing 2. On the exchangeable platen 6, fabric (an object on which an image is printed) such as a T-shirt is held horizontally. On the upper surface of the platen 6, an anti-slip (gripping) member, not shown, is provided so that the fabric tensely held on the platen 6 will not shift during the imaging procedure. In order to allow setting (placing) of the fabric (e.g., the T-shirt) on the platen 6 easily, end corners of the rectangular shape of the platen 6 are cut out.

A tray 7 is secured to the supporting column 5, which is located at a substantially central position between the platen 6 and the platen supporting table 4. The tray 7 has a bottom surface that is substantially parallel with the upper surface of the platen 6. When viewed from the top, the outline of the tray 7 is slightly larger than that of the platen 6. The tray 7 is provided to prevent the fabric from falling down onto the bottom surface of the housing when the operator mistakenly let the fabric fall from the platen 6.

As shown in FIG. 1, in the vicinity of the rear ends of the guide rails 3 and 3 (at the ends of the guide rails 3 on the rear side of the housing 2), a platen motor 8 is provided. The platen motor 8 is driven to move the platen supporting table 4 in the anteroposterior direction of the housing 2 along the guide rails 3 and 3.

Although not shown in the drawings, a driving belt is wound around a driving shaft of the platen motor 8 and a pulley arranged in the vicinity of the front ends of the guide rails 3 and 3 (i.e., at the ends of the guide rails on the front side of the housing 2), while the platen supporting table 4 is fixedly secured to the driving belt. As the platen motor 8 is driven to rotate, the belt moves and thus the platen supporting table 4 moves along the guide rails 3 and 3.

As shown in FIG. 2, at the front end portion of the guide rails 3 and 3, a photo sensor 3*b* for detecting a presence of the platen 6 is provided. By use of the photo sensor 3*b*, it is detected that the platen 6 becomes closer to the rear end of the movable range, when the platen 6 is moved from the rear side to the front side of the housing 2 during the imaging procedure. Further, at the rear end portion of the guide rails 3 and 3, a photo sensor 3*c* for detecting the platen 6 is provided. By use of the photo sensor 3*c*, it is detected that the platen 6 is located at the starting position of the movable range in which the platen 6 is moved during the imaging procedure. Each of the photo sensor 3*b* and 3*c* includes light emitting unit and light receiving unit, and whether an object (i.e., platen 6) is present or absent is determined depending on whether the light emitted by the light emitting unit is reflected by the object and received by the light receiving unit. Such a reflection type photo sensor is well known and the detailed structure is not shown in the drawings.

On the lower surface of the platen supporting table 4, a light shielding plate 4*a*, which can be located between the light emitting unit and light receiving unit of each of the photo sensors 3*b* and 3*c*, is protruded from the platen 6. When the light shielding plate 4*a*is located between the light emitting unit and light receiving unit of each of the photo sensors 3*b* and 3*c*, it is detected that the platen 6 is located at respective photo sensors 3*b* and 3*c*. The platen motor 8 is a stepping motor 8, and with reference to the starting position and terminal position of the platen 6, which are determined based on the output of the photo sensors 3*b* and 3*c*, the location of the platen 6 is detected and/or controlled.

As shown in FIGS. 1 and 2, a guide rail 9 is bridged between both side surfaces of the housing 2 at a substantially central position in the anteroposterior direction, at a level higher than the level of the platen 6. The guide rail 9 is for guiding a carriage 20 that mounts an inkjet head 21.

A carriage motor 10 is provided in the vicinity of the left-hand side end (FIGS. 1 and 2) of the guide rail 9, and a pulley 11 is provide in the vicinity of the right-hand side end of the guide rail 9. A carriage belt 10*a* is wound between the carriage motor 10 and the pulley 11 so that it extends in right-and-left direction of the housing 2. The carriage belt 10*a* is fixedly secured to the rear surface of the carriage 20. Further, the rear surface of the carriage 20 is formed to slidably engage with the guide rail 9. As the carriage motor 10 rotates, the carriage 20 moves in right or left direction depending on the rotation of the carriage motor 10 as guided by the guide rail 9. According to the embodiment, the carriage motor 10 is a DC motor. A linear encoder (not shown) is provided to the guide rail 9, and the position of the carriage 20 is detected and/or controlled based on the output of the linear encoder.

The outer shape of the carriage 20 is a substantially rectangular solid. On the bottom surface of the carriage 20, four piezoelectric type inkjet heads 21 are mounted. The four inkjet heads 21 correspond to, for example, cyan, magenta, yellow and black color inks. Each of the inkjet heads 21 has, for example, 128 channels for ejecting the ink. Piezoelectric actuators, which can be driven individually, are provided to the channels, respectively, and minute ink ejecting nozzles (not shown) are pierced, corresponding to the channels, on the bottom surface of each inkjet head 21. By driving the piezoelectric actuators selectively, ink drops are ejected through the nozzles selectively.

On both side surfaces (right and left side surfaces) of the housing 2, cartridge cases 12 are provided. Each cartridge case 12 is configured such that two ink cartridges 13 and 13 can be detachably attached thereto. The ink is supplied from the ink cartridges 13 to respective ones of the inkjet heads 21 via tubes (not shown).

According to the embodiment, the inkjet printer 1 is provided with a purge mechanism, a wiping mechanism and a flushing mechanism for recovering a function of the inkjet head 21.

Specifically, a purge mechanism 14 is provided at a position facing the carriage 20 when it is located at the right-hand end position in FIG. 2 of the housing 2. The purge mechanism 14 has a suction cap 15 which can be closely contacted and spaced with respect to a nozzle surface of each inkjet head 21. The purge mechanism 14 is for suctioning the ink from the nozzle surface of each inkjet head 21 (i.e., executing a purging operations).

Specifically, the purge mechanism 14 is connected with a valve 22 that adjusts air pressure inside the suction cap 15 and a suction pump 23 through piping tubes as shown in FIG. 2. The valve 22 is opened to the air immediately before the suction cap 15 closely contacts the inkjet head 21, and is closed when the suction cap 15 closely contacts the inkjet head 21. Further, the valve 22 is controlled to open before the suction cap 15 is separated from the inkjet heads 21 to adjust the air pressure so that bubbles will not be generated inside the suction cap 15. When the suction cap 15 closely contacts each inkjet head 21, by actuating the suction pump 23, the ink on the nozzle surface of the inkjet head 21 can be vacuumed via the suction cap 15. Further, when the imaging operation is not executed, the suction cap 15 covers the nozzle surfaces of the inkjet head 21, thereby drying of the ink can be prevented.

Next, a wiping mechanism 30 that performs a wiping operation for wiping out the ink adhered onto the nozzle surfaces of the inkjet heads 21 will be described. The wiping mechanism 30 is located, similarly to the purge mechanism 14, at a right-hand side position of the housing 2 as shown in FIG. 1. In FIG. 2, the wiping mechanism 30 is located behind the purging mechanism 14 (i.e., on the rear side of the purging mechanism 14), it is not shown in FIG. 2.

Figure 3:
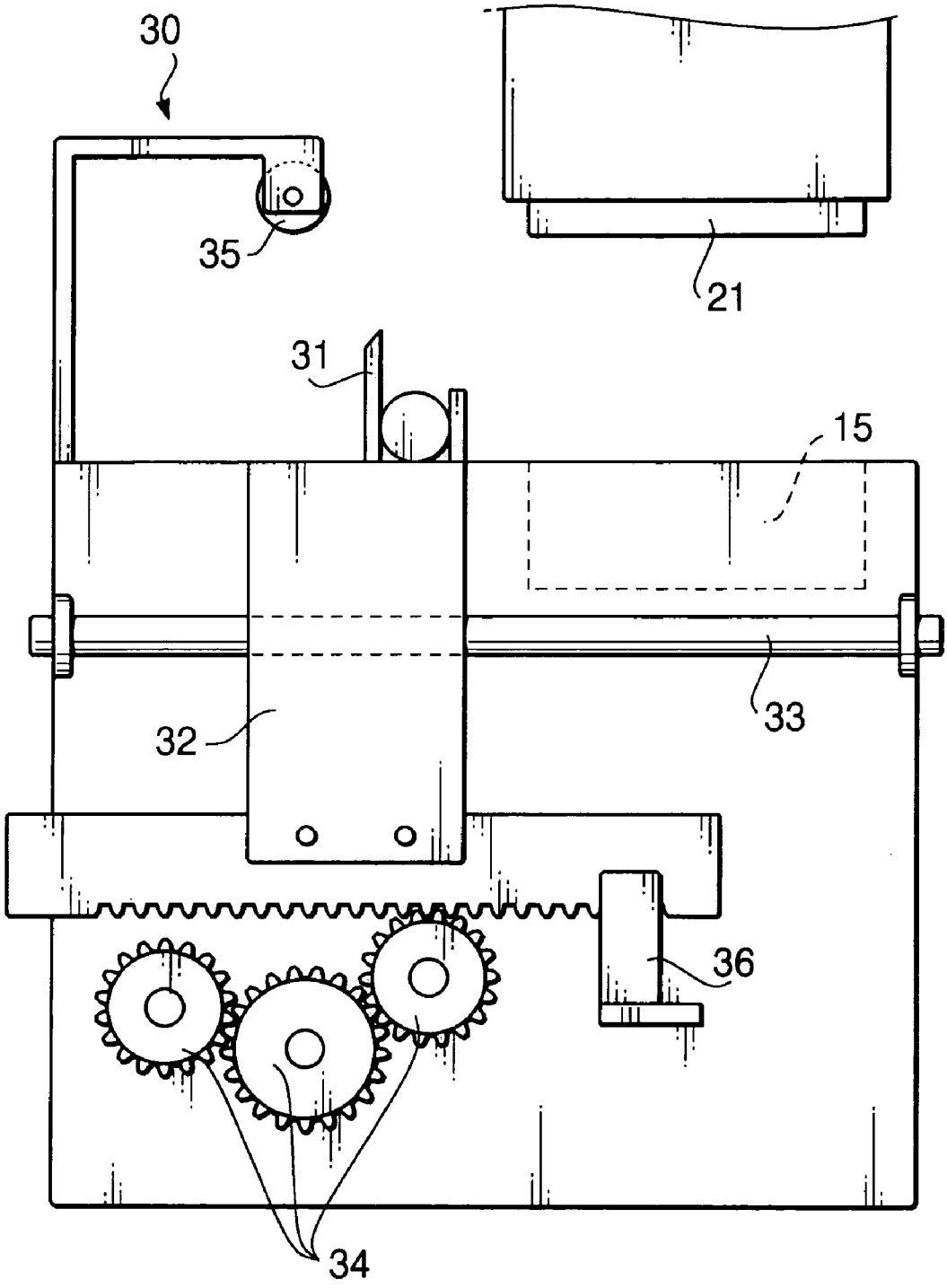
FIG. 3 is a front view of a wiping mechanism viewed from a direction in which a carriage moves.
Figure 4:
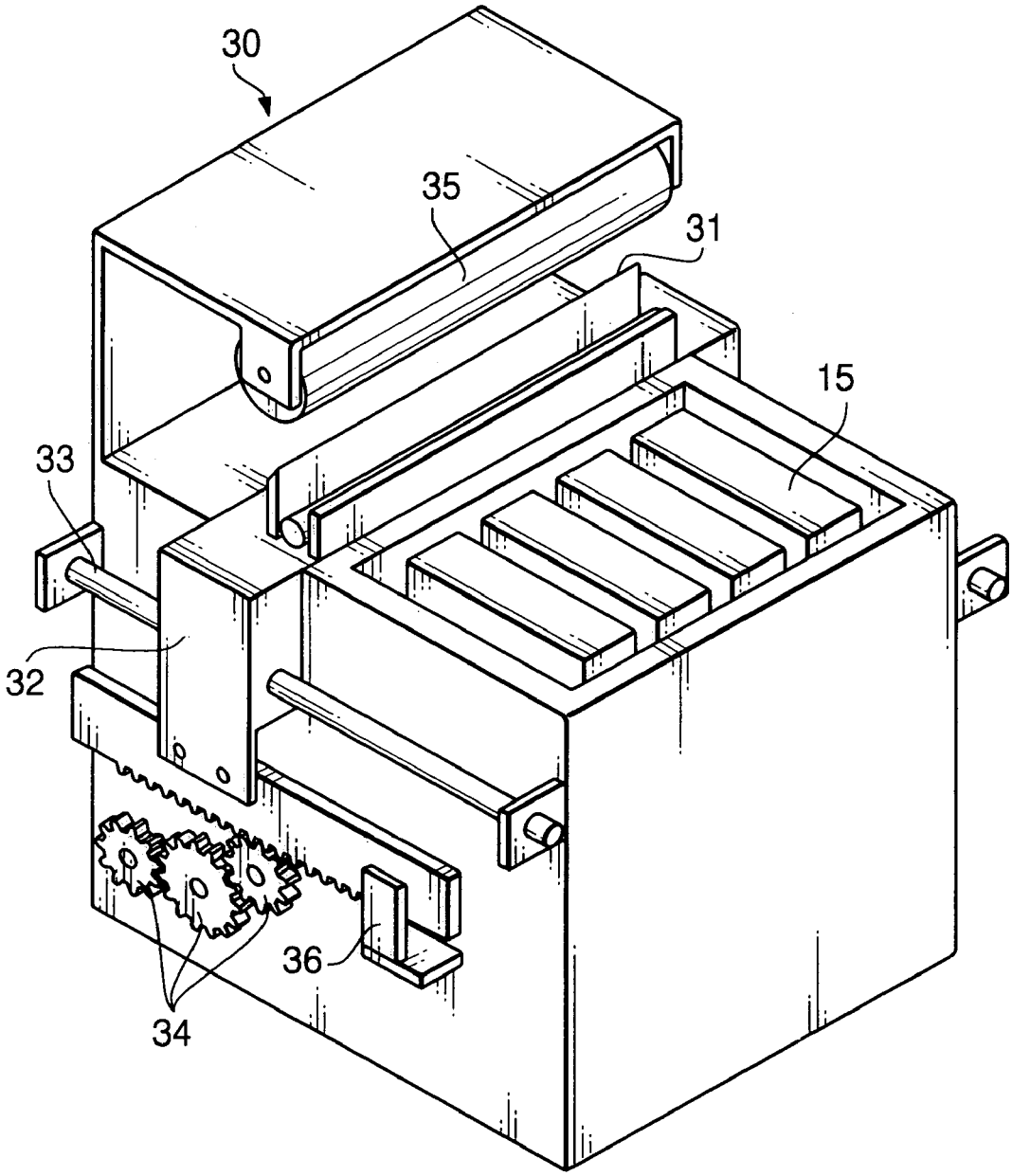
FIG. 4 is a perspective view of the wiping mechanism.

FIG. 3 shows a front view of the wiping mechanism 30 viewed from a direction in which the carriage 20 moves, and FIG. 4 is a perspective view of the wiping mechanism 30.

As shown in FIGS. 3 and 4, the wiping mechanism 30 is provided with a wiper 31 for wiping the ink from the nozzle surfaces of the inkjet heads 21, a wiping unit 32 that carries the wiper 31 and moves, a guide 33 that guides the moving direction of the wiping unit 32, a gear train 34 which is a moving mechanism of the wiping unit 32, a wiper cleaner 35 used for maintenance of the wiper 31 after the wiping operation to remove the ink adhered on the wiper 31 and a sensor 36 for detecting an origin point of the wiping unit 32, a location of the wiping unit 32 being controlled with reference to the origin point.

The purging mechanism 14 functions as follows.

When the purging operation is finished, the suction cap 15 of the purging mechanism 14 is separated from the inkjet heads 21 and is moved downward. The inkjet printer 1 rotates a motor (not shown) to move the wiping unit 32 along the guide 33 to execute the wiping operation in which the nozzle surfaces of the inkjet heads 21 are wiped with the wiper 31. Thereafter, the motor is reversely rotated to move back the wiping unit 32 to the position of the wiper cleaner 35. Then, with the wiper cleaner 35, the wiper 31 is cleaned.

A left-hand side position of the carriage 20 in FIG. 2 is a flushing position at which a flushing operation of the inkjet heads 21 is performed. As shown in FIG. 2, at the flushing position, a flushing mechanism 40 that receives the ink flushed by the inkjet heads 21 is provided. The flushing operation is an operation to have the ink resides in the vicinity of the ejecting nozzles discharged therefrom. If the ink in the vicinity of the nozzles contains bubbles, they affect the printing operation. Therefore, it is necessary to remove the ink in the vicinity of the nozzles by performing the flushing operation.

As shown in FIG. 2, the ink suctioned in the purging operation executed by the purging mechanism 14 passes, through the piping and a drain valve 51, to a waste ink tank 50 and stored therein as a waste ink. The drain valve 51 is provided at an intermediate position of the piping tube, in which the waste ink flows, at a position close to the waste ink tank 50, and regulates the amount of the ink flowing into the waste ink tank 50. The drain valve 51 is opened to the air if the pressure inside the suction cap 15 is to be adjusted to the air pressure when the cap 15 is closed/opened. It should be noted that the drain valve 51 is normally closed in order to prevent the inside of the piping from being dried.

Further, the ink ejected from the inkjet heads 21 as the flushing operation is executed by the flushing mechanism 40 is directed to the waste ink tank 50 via the piping tube as the ink falls freely and stored therein as the waste ink. As illustrated in FIG. 2, there are no drain valves in the piping tube connecting the flushing mechanism 40 and the waste ink tank 50. The waste ink in the flushing mechanism 40 always flows into the waste ink tank 50. As shown in FIG. 2, the piping tube from the flushing mechanism 40 and the piping tube provided with the drain valve 51 join together in front of the waste ink tank 50.

As shown in FIGS. 1 and 2, on a front left-hand side of the housing 2, an operation panel 16 for operating the inkjet printer 1 is provided. The operation panel 16 is provided with a plurality of operation buttons including a print start button 16*a*, which is operated when the operator has finished setting the fabric (e.g., T-shirt) onto the platen 6 and the printing operation can be started.

Further, on a rear left-hand side portion inside the housing 2, a control unit 100 including a CPU 110 that controls the operation of the inkjet printer 1 is provided. A power supply line 55 is extended, through which an electric power is supplied to the inkjet printer 1 via the control unit 100.

Figure 5:
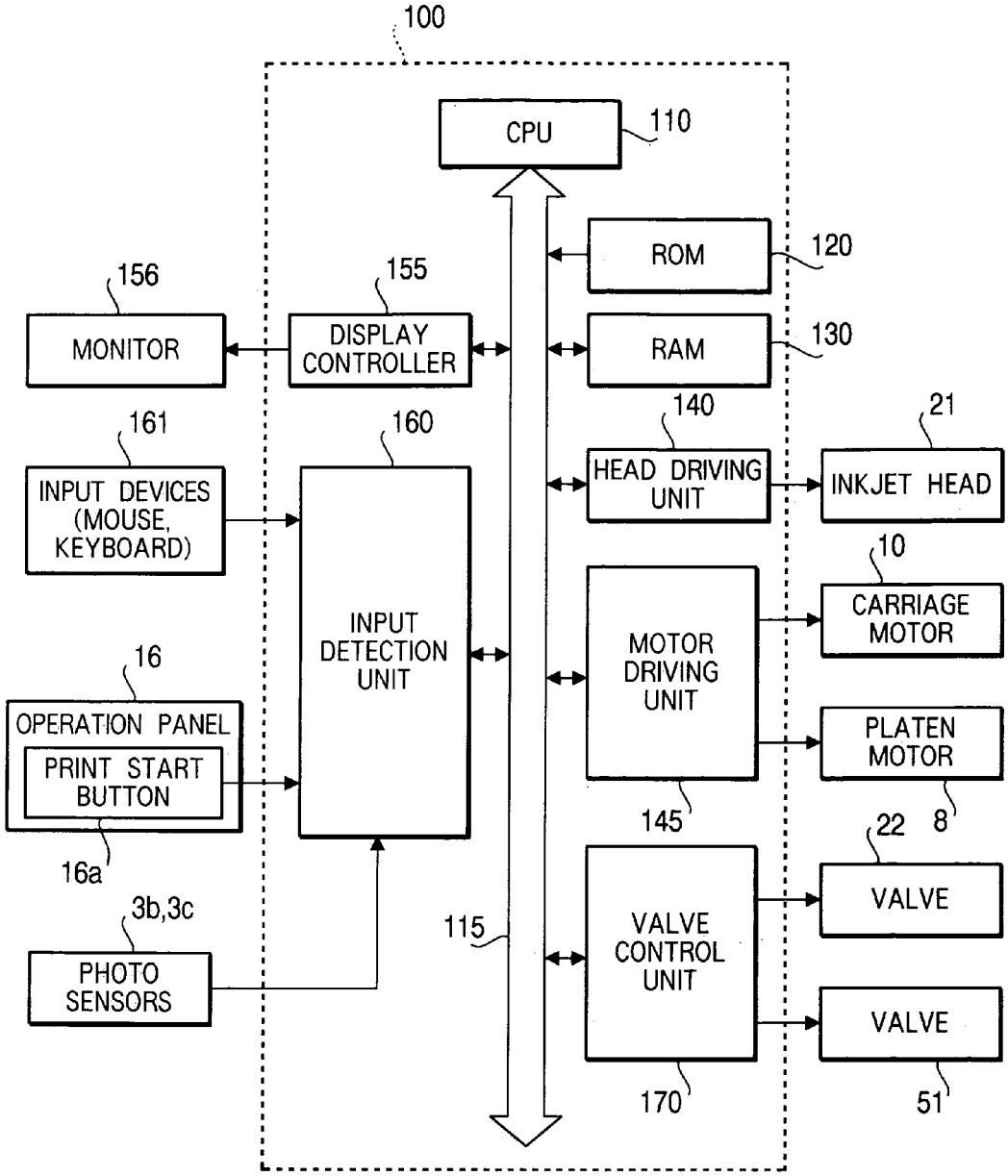
FIG. 5 is a block diagram illustrating an electrical configuration of the inkjet printer shown in FIG. 1.

FIG. 5 is a block diagram showing an electrical configuration of the inkjet printer 1.

As shown in FIG. 5, the control unit 100 includes the CPU 110, a ROM (Read Only Memory) 120, a RAM (Random Access Memory) 130, a head driving unit 140, a motor driving unit 145, a display controller 155, an input detection unit 160 and a valve control unit 170 which are interconnected through a bus 115.

The CPU 110 controls the entire operation of the inkjet printer 1 is provided. The ROM 120 stores control programs to be executed by the CPU 110 and the RAM 130 temporarily stores data, for example, one used when the CPU 110 executes the control programs. As the CPU 110 executes the control programs stored in the ROM 120, various operations including ones described below are performed.

The head driving unit 140 is for driving piezoelectric actuators provided to respective channels of the inkjet heads 21, and the motor driving unit 145 is for driving the carriage motor 10 and a platen motor 8.

Further, the display controller 155 is for displaying images which are to be printed on the fabric (e.g., T-shirt) on a monitor 156, and the input detection unit 150 through which the operator inputs various commands. The input detection unit 160 is connected with input devices 161 such as mouse and keyboard. To the input detection unit 160, the photo sensors 3*b* and 3*c*, the print start button 16*a* and other operation buttons etc. are connected. According to the embodiment, the monitor 156 and the input devices 161 are those implemented with a personal computer (not shown), and the inkjet printer 1 is validly connected with the personal computer.

The valve control unit 170 controls each of the valve 22 and the drain valve 51. Specifically, the valve control unit 170 turns on/off a port of a solenoid to excite/unexcite the solenoid so that each of the valves 22 and 51 is opened/closed.

Hereinafter, referring to FIGS. 6–10, a maintenance procedure (a recovery procedure) of the inkjet head 21 executed by the inkjet printer 1 will be described.

Figure 6:
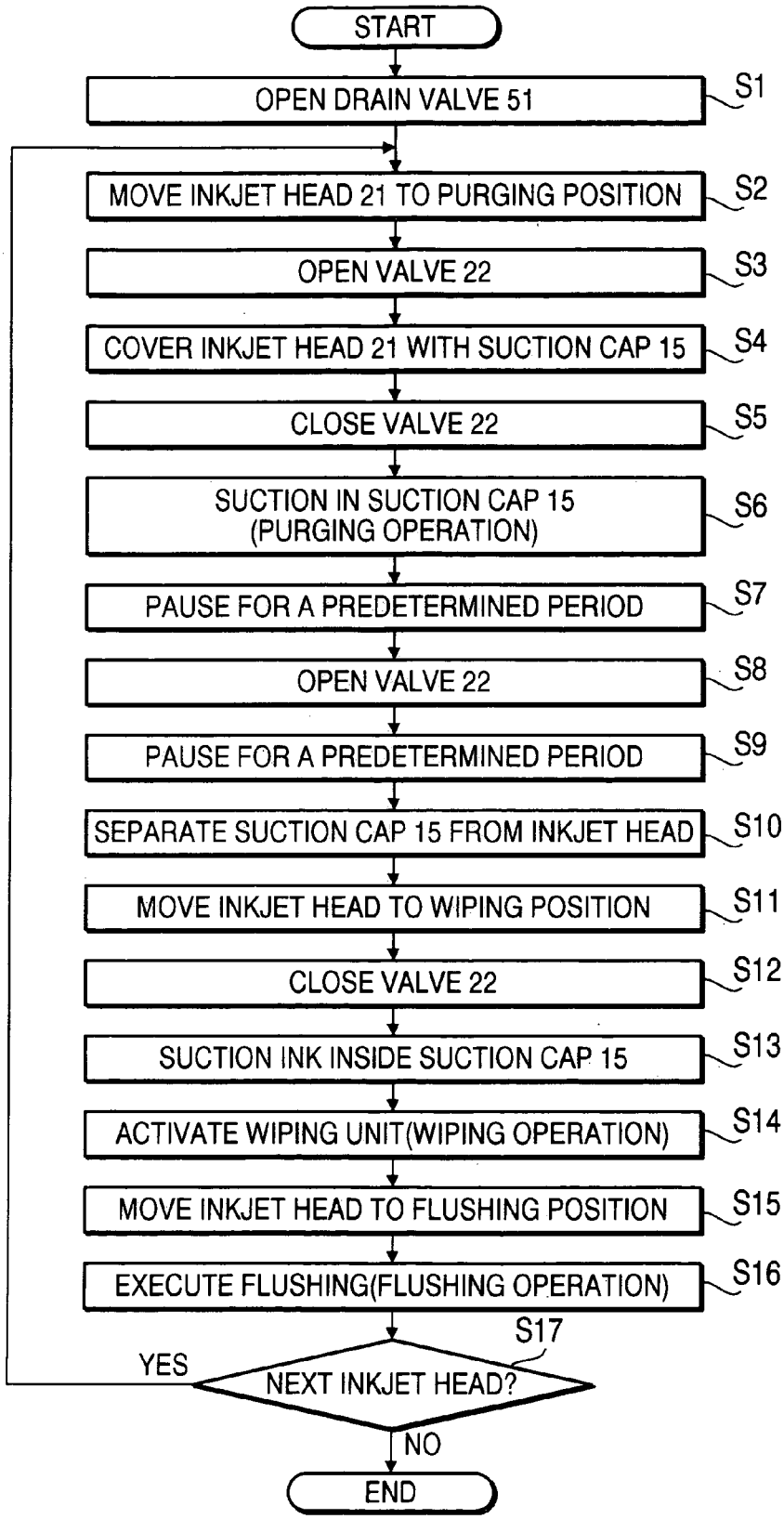
FIG. 6 is a flowchart illustrating a main procedure of a maintenance procedure.
Figure 7:
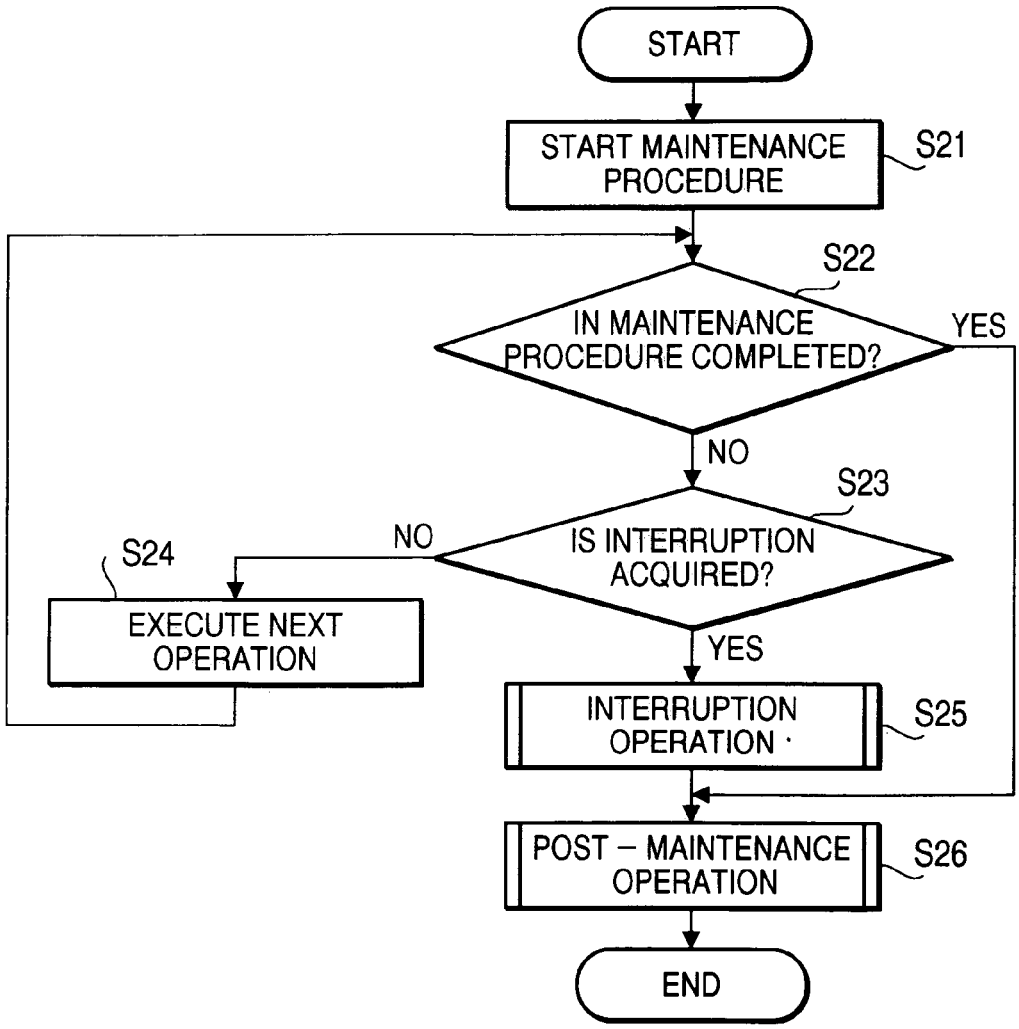
FIG. 7 is a flowchart illustrating an interruption control process of the maintenance procedure.
Figure 8:
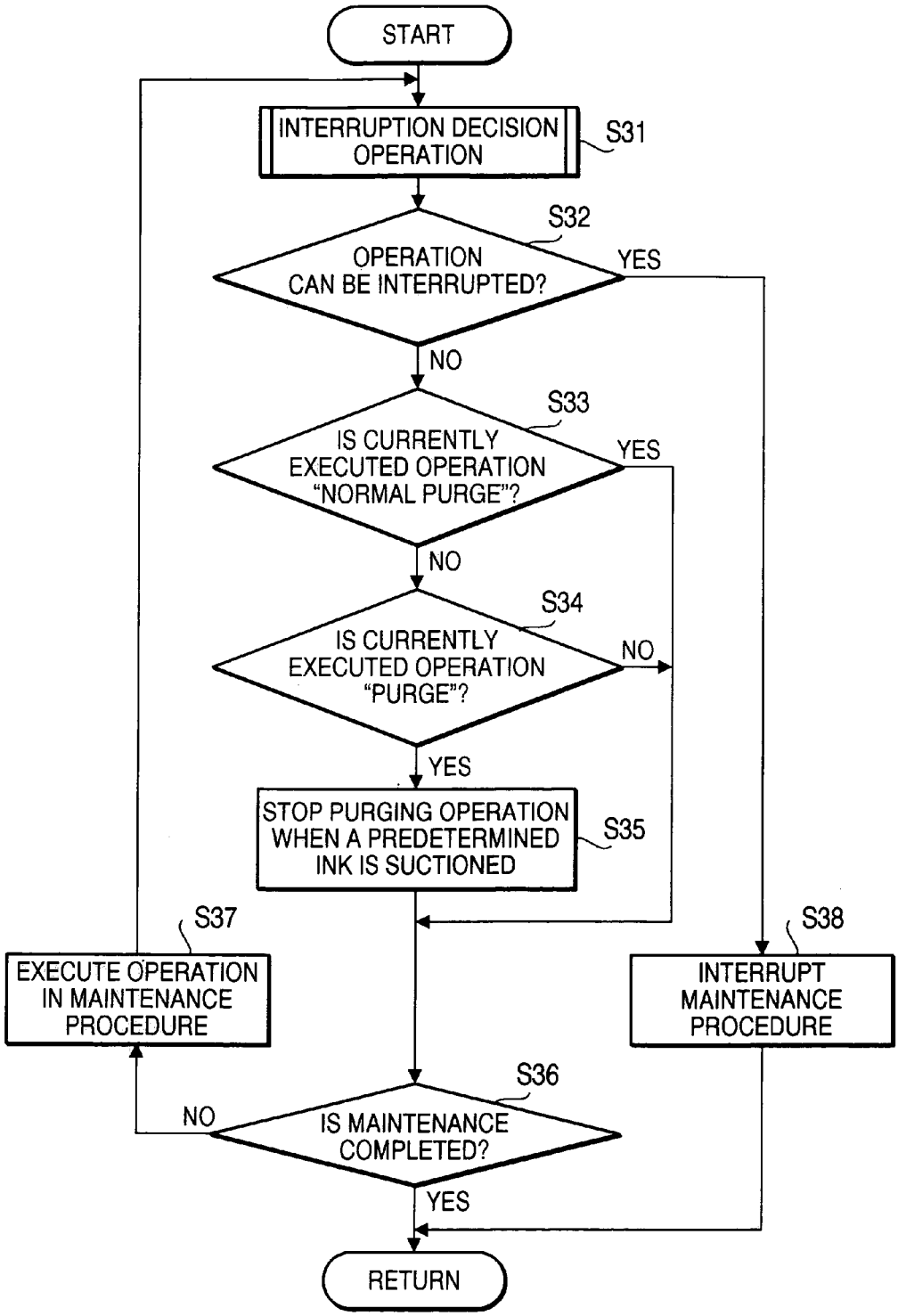
FIG. 8 is a flowchart illustrating a detailed flow of the interruption process of the maintenance procedure.
Figure 9:
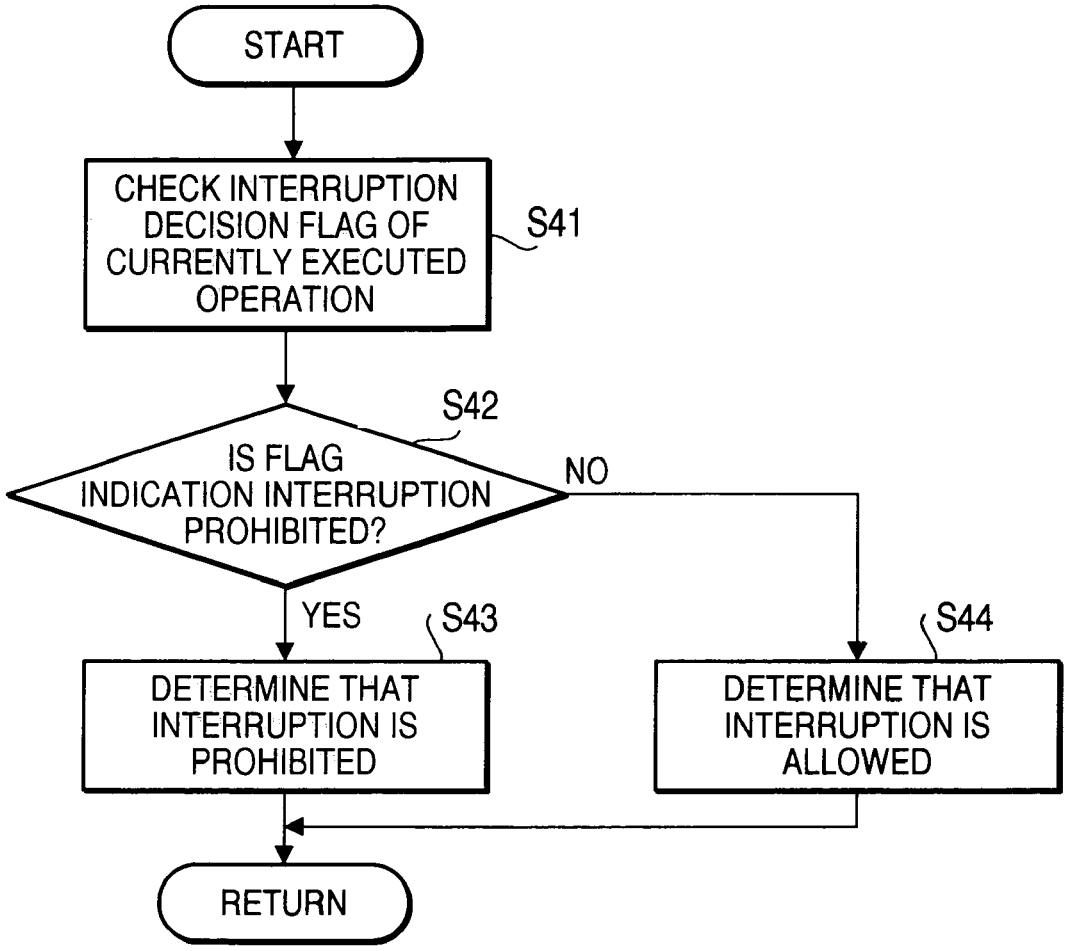
FIG. 9 is a flowchart illustrating an interruption determination process of the maintenance procedure.
Figure 10:
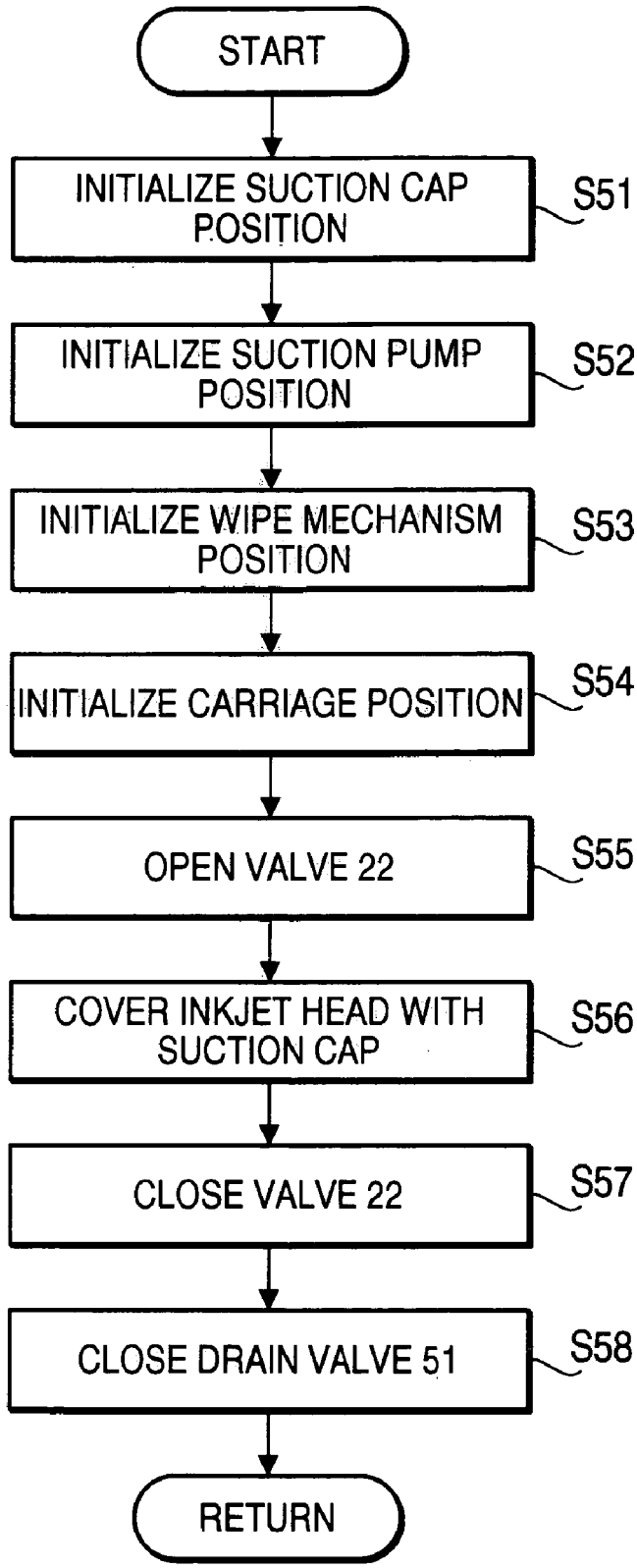
FIG. 10 is a flowchart illustrating a post-maintenance operation.

FIG. 6 is a flowchart illustrating a maintenance procedure of the inkjet printer 1. FIG. 7 is a flowchart illustrating an interruption control process of the maintenance procedure. FIG. 8 is a flowchart illustrating a detailed flow of S25 of the interruption process shown in FIG. 7. FIG. 9 is a flowchart illustrating an interruption determination process which is executed in S31 of FIG. 8. FIG. 10 is a flowchart illustrating a detailed flow of a post-maintenance operation executed in S26 of FIG. 7.

According to the embodiment, after the ink cartridges have been exchanged, a maintenance procedure (e.g., an initial purging operation) is executed. When the operator of the inkjet printer 1 has found deficiency of pixels in a printed image, the operator operates a maintenance button provided on the operation panel 16 or operating driver software running on the personal computer (not shown) for the maintenance procedure. In addition to the above case, when a predetermined time period has passed since the previous maintenance procedure or a predetermined number of maintenance procedure have been executed, the maintenance procedure is executed automatically.

When the maintenance procedure is started, as shown in FIG. 6, the drain valve 51 that closes the piping tube, which is a passage of the waste ink toward the waste ink tank 50 (S1) is open. Then, the CPU 110 controls the motor driving unit 145 to drive the carriage motor 10, thereby the inkjet heads 21 being moved to the purging position (S2). Specifically, one of the four inkjet heads 21 subject to the purging operations is located at a position facing the purging mechanism 14 (i.e., the right-hand position of the housing 2 in FIG. 2).

Next, the valve 22 at the midst of the ink passage from the suction cap 15 to the inkjet heads 21 of the piping tube is opened (S3). Then, the suction cap 15 is lifted up toward one (target) of the inkjet heads 21 so that the nozzle surface of the inkjet head 21 is covered with the suction cap 15 (S4). Then, the valve 22 is closed (S5). In S6, the suction pump 23 is activated to execute the purging operation (S6) to vacuum the ink from the nozzles of the inkjet head 21. The ink vacuumed from the nozzles is sent to the waste ink tank 50 via the drain valve 51 as the waste ink and is stored therein. After the purging operation is finished, process is paused for a predetermined period of time (S7) so that the state of the ink in the suction cap 15 is settled from a flowing state to a steady state. Thereafter, the valve 22 connected to the suction cap 15 is opened (S8). It should be noted that the pressure inside the suction cap 15 immediately after suctioning of the ink is lower than the air pressure. Therefore, if the suction cap 15 is separated from the inkjet head 21, the air flows in and bubbles are generated in the ink inside the suction cap 15. In order to prevent such a problem, in S8, the valve 22 is opened so as to make the pressure inside the suction cap 15 equal to the air pressure. By this operation, the ink inside the suction cap 15 may flow. Therefore, after the predetermined period of pausing (S9), the suction cap 15 is separated from the inkjet head 21 (S10).

After the suction cap 15 is separated from the inkjet head 21, the inkjet head 21 are moved to the wipe position where the wiping mechanism 30 is provide (S11). While the inkjet heads 21 are moving to the wipe position, the valve 22 connected to the suction cap 15 is closed (S12) and the suction pump 23 is activated to suction the residual ink inside the suction cap 15 (S13). When the inkjet head 21, to which the purging operation is applied, reaches the wipe position, the wiping unit 32 is moved toward the inkjet head 21. Then, the wiping operation is executed to wipe out the nozzle surfaces of the inkjet head 21 with the wiper 31 (S14). With this wiping operation, the ink adhered to the nozzle surface of the inkjet head 21 is wiped out and the inkjet head 21 are brought into a condition for printing.

Next, the inkjet head 21 is moved to the flushing position (S15), where the inkjet head 21 subject to the flushing operation faces the flushing mechanism 40 provided at the left-hand side portion of the housing in FIG. 2. Then, the flushing operation is performed (S16). In the flushing operation, a driving voltage higher than that for printing is applied to each piezoelectric actuator so that the amount of the ejected ink more than that for printing is ejected from each ink ejecting nozzle of the inkjet head 21 toward the flushing mechanism.

When the flushing operation is performed, the CPU 110 transmits flushing commands to the head driving unit 140. Specifically, by sending the flushing commands, the CPU 110 writes the number of executions, an interval thereof and information regarding the inkjet head 21 subject to the flushing operation in a controlling register of the head driving unit 140. Thereafter, when the CPU 110 writes a flushing start instruction in ther control register of the head driving unit 140, the piezoelectric actuator is driven to execute the flushing operation in accordance with the number of executions and interval stored in the control register.

During purging operation (S6) and wiping operation (S14), the amount of the bubbles included in the ink located in the vicinity of the nozzles of the inkjet heads 21 may be greater than that for the normal printing operation. Therefore, in the flushing operation, greater amount of ink should be ejected so that the ink containing the bubbles are discharged. It is noted that, in the flushing operation, the ejection of the ink is executed by a plurality of times.

After the above procedure the CPU 110 determines whether there is another inkjet head 21 subject to the maintenance operation (S17). When there remains the inkjet head 21 to which the maintenance operation should be applied (S17: YES), process returns to S2, while when the maintenance procedure has been applied to all the inkjet heads 21 (S17: NO), the maintenance procedure is terminated.

The sequence of the maintenance procedure performed in the inkjet printer 1 has been described. Next, a case where the maintenance procedure according to the above-described sequence is interrupted as, for example, the operator cancels the maintenance procedure will be described.

As shown in FIG. 7, the CPU 110 starts the maintenance procedure (S21) illustrated in FIG. 6 when the operator operates a predetermined switch or when a predetermined condition is satisfied. According to the embodiment, the maintenance procedure is started when the drain valve 51 is opened (S1).

Next, the CPU 110 determines whether the maintenance procedure has been finished (S22). When the maintenance procedure has not been finished (i.e., it is currently performed) (S22: NO), the CPU 110 determines whether interruption of the maintenance procedure has been instructed (S23). According to the embodiment, when the interruption of the maintenance is instructed (as the operator inputs an instruction to cancel the maintenance procedure, for example), the CPU 110 determines that the instruction to interrupt the maintenance procedure has been acquired.

When the instruction of interruption is not acquired (S23: NO), if the currently executed process in the sequence of the maintenance procedure is finished, a succeeding process is executed (S24), and control returns to S22. Specifically, when the drain valve 51 is opened in S21 (S1), the maintenance procedure has not been finished (S22: NO). Therefore, if the interruption of the maintenance procedure has not been acquired (S23: NO), a succeeding step (i.e., S2) is executed in S24.

When the CPU 110 determines that the maintenance procedure has been finished (S22: YES), the post-maintenance operation is executed (S26), which will be described later. According to the embodiment, the CPU 110 determines that the maintenance procedure has been finished when the CPU 110 determines that the there is no inkjet head 21 to which the maintenance procedure is applied (S17: NO) in S24.

When the CPU 110 acquires the interruption of the maintenance procedure (S23: YES) before completion (S22: NO), the maintenance interruption operation is executed (S25), which will be described later. Thereafter, similar to a case where the maintenance operation is finished (S22: YES), the post-maintenance operation is executed (S26).

In the maintenance interruption operation executed in S25, as shown in FIG. 8, the CPU 110 executes the maintenance interruption determining operation (S31) to determine whether the currently executed operation can be interrupted (S32). When the CPU 110 determines that the currently executed operation cannot be interrupted (S32:

NO), the CPU 110 determines whether the operation mode of the currently executed maintenance operation is the "normal purge" mode (S33).

In the embodiment, the maintenance procedure includes a plurality of operation modes, which includes: the "normal purge" mode in which a normal maintenance procedure is executed; a "powered purge" mode in which the suctioning amount in the purging operating is grater than that of the normal purge mode; and an "initial purge" mode which is automatically executed when the inkjet printer 1 is newly implemented or the inkjet heads 21 have been exchanged.

By selecting an appropriate operation mode from among the above-described operation modes, an optimum maintenance operation can be performed. For example, the powered purge mode requires a longer operation period than the normal purge operation. However, if the operator needs a higher image quality even though the purging period becomes longer, the operator should select the powered purge mode.

When the CPU 110 determines that the operation mode of the currently executed maintenance procedure is not the normal purge mode (S33: NO), the CPU 110 determines whether the currently executed operation is the purge operation in another operation mode (S34). When the currently executed operation is the purging operation (S34: YES), the CPU 110 stops the purging operation after a predetermined amount of ink is suctioned from the inkjet head 21 (S35).

In S35, when a predetermined amount of ink is suctioned, the purging operation is stopped. If the maintenance operation cannot be interrupted regardless of the operator's instruction, it is preferable that a period for the maintenance procedure is shortened as much as possible. However, when the operation mode is not the normal purge mode, another mode, for example, the powered purge mode, which requires a relative long time period is being selected and executed. According to the invention, in such case, when the minimum amount of ink is suctioned, the purging operation is interrupted so that the operator's waiting time is shortened. It should be noted that, in S33, when the operation mode is the normal purge mode, the suctioned amount of the ink is not lessened as is done in S35. It is because, in the normal purge mode, only the minimum amount of ink is suctioned.

In contrast, when the CPU 110 determines that the currently executed mode is the normal purge mode (S33: YES), the currently executed operation is not the purging operation (S34: NO), or the purging operation is interrupted after the predetermined amount of ink has been purged (S35), the CPU 110 determines whether the maintenance procedure has been finished (S36). When the maintenance procedure has not been finished (S36: NO), a succeeding process in the currently executed maintenance procedure is executed (S37). Thus, until control reaches a step at which the maintenance procedure can be interrupted, the sequence of the maintenance procedure is executed, or alternatively, the maintenance procedure itself is completed.

When the CPU 110 determines that the operation can be interrupted (S32: YES), the CPU 110 stops the currently executed operation to interrupt the maintenance procedure (S38) and finish the same. Thereafter, control proceeds to S26 of FIG. 7.

As above, even if the maintenance procedure is being executed, if the currently executed process can be interrupted, the process is interrupted immediately, thereby the maintenance operation can be interrupted. When the currently executed process cannot be interrupted, when the sequence advances and a process that can be interrupted is executed, the process is interrupted, and the maintenance procedure is interrupted. Therefore, for the operator, the maintenance procedure can be stopped within the minimum waiting time period, which reduces a load (e.g., the waiting time period) to the operator.

FIG. 9 shows a detailed procedure of the interruption determination operation, which is executed in S31 of FIG. 8.

The CPU 110 checks an interruption decision flag for the currently executed process (S41) to determine whether a flag indicating that the currently executed process cannot be interrupted (S42). That is, according to the embodiment, in order to determine whether each process included in the sequence of the maintenance procedure can be interrupted, the interruption decision flag assigned to each process is checked. Specifically, in the control programs stored in the ROM 120, a program for executing the maintenance procedure is included. In the maintenance program, a sequence (procedure) of the maintenance procedure and parameters (e.g., flags) are defined. The above-described flag indicating whether each step can be interrupted is included in the parameters. The CPU 110 determines whether each executed operation can be interrupted by checking the interruption decision flag.

When the CPU 110 determines that there is a flag indicating that the currently executed operation cannot be interrupted (S42: YES), the CPU 110 determines that the operation cannot be interrupted (S43). When the CPU 110 determines that there is not the flag indicating that the currently executed process cannot be interrupted (S42: NO), the CPU 110 determines that the process can be interrupted (S44). After the decision in S43 or S44, control returns to the process shown in FIG. 8.

In the maintenance procedure shown in FIG. 6, among a plurality of steps included in the procedure, for at least one from the purging operation (S6) to the wiping operation (S14), the interruption decision flags indicating the interruption is not allowed, respectively. Thus, when these steps are executed, the maintenance procedure cannot be interrupted. During the steps from the purging operation (S6) to the wiping operation (S14), the inkjet heads 21 (particularly the nozzle surfaces and ejection nozzles) are directly handled. Therefore, if the operation is interrupted during such operations, there would be a bad effect on the inkjet heads 21, which may have a bad effect on images formed thereafter. Therefore, when the steps are executed, the interruption is prohibited.

On the contrary, when the steps other than those from the purging operation (S6) to the wiping operation (S14) are executed, the interruption is allowed since even if such operations are interrupted, a bad effect on the inkjet printer 1 would not be occur.

In conventional printers, the maintenance procedure cannot be interrupted. Therefore, even if the operator wishes to cancel the maintenance procedure, one it has started, the operator should wait for completion of the same. According to the embodiment described above, even when the maintenance procedure is being executed, the inkjet printer can receive the instruction/command to interrupt the maintenance procedure, and interrupts the maintenance procedure in an appropriate step (i.e., in a step in which even if the maintenance procedure is interrupted, there would not be a bad effect on the printer). Accordingly, a convenient inkjet printer can be provide, with which the unnecessary waiting time of the operator can be reduced.

After the maintenance procedure is interrupted (S25) or the maintenance procedure is finished (S22: YES), the post-maintenance operation (S26) shown in FIG. 10 is executed. In this operation, regardless whether the maintenance procedure has been interrupted or completed, the operational condition of the inkjet printer 1 is returned to its default mode.

In the post-maintenance operation (FIG. 10), the CPU 110 first initializes the position of the suction cap 15 and moves the suction cap to its home position in the default condition (S51). Further, the CPU 110 initializes the position of the suction pump 23 and moves the suction pump 23 to its home position in the default condition (S52). In S53, the CPU 110 initializes the position of the wiping mechanism 30 and moves the wiping mechanism 30 to its home position in the default condition. Further, the CPU 110 initializes a position of the carriage 20 and moves the carriage 20 to its home position in the default condition (S54). After moving the above members (i.e., the suction cap 15, the suction pump 23, the wiping mechanism 30 and the carriage 20) which were moved in the maintenance procedure have been returned to their home positions in the default condition, the CPU 110 opens the valve 22 (S55). Then, the suction cap 15 is lifted up to cover the nozzle surfaces of the inkjet heads 21 with the suction cap 15 (S56). Thereafter, the valve 22 is closed (S57) and the drain valve 51 is closed (S58).

By executing the post-maintenance operation shown in FIG. 10, the inkjet printer 1 is brought to its default condition, and the nozzle surfaces of the inkjet heads 21 are covered with the suction cap 15. Even if the inkjet printer 1 is stopped at this stage, since the nozzle surfaces of the inkjet heads 21 are covered with the suction cap 15, they will not be exposed to the air with being in wet condition, and thus no bad effect will be caused for succeeding printing operations.

As described above, after the post-maintenance operation has been executed (S26 of FIG. 7), the operational status of the inkjet printer has been changed from the maintenance procedure executing condition to the relatively stable default condition. It should be noted that the post-maintenance operation is executed regardless whether the maintenance procedure is interrupted or completed. Thus, when the inkjet printer 1 is stopped after the maintenance operation (interrupted or completed), the operational condition is brought in the stable default condition.

It should be noted that the invention need not be limited to the above-described exemplary embodiment, and various modifications can be made without departing from the scope of the invention.

For example, in the above-described embodiment, particularly, in the maintenance procedure shown in FIG. 6, for the steps from the purging operation (S6) to the wiping operation (S14), the interruption flags are set to indicated that the interruption is inhibited. However, in practice, the operator of designer may arbitrarily set each step to allow/inhibit interruption.

For example, in FIG. 6, the flushing operation (S16) is very important operation to retain the printing performance of the inkjet heads 21. Therefore, in order to further reduce a possibility of occurrence of malfunction due to the maintenance operation, the steps from the purging operation (S6) to the flushing operation (S16) may be set such that the interruption is prohibited.

It should be noted that the present invention is not limited to application to the maintenance operation. To any operation consisting of a sequence of steps, the invention can be applied.

In the above-described embodiment, whether each step can be interrupted or not is determined based on the flag associated with the step. The invention need not be limited to such a configuration, and any method may be employed if the CPU can determine whether each step can be interrupted or not. Of course, instead of using a flag indicating that interruption is prohibited, another flag indicating that interruption is allowed. Alternatively, the inkjet printer may be configured such that a decision table indicating whether the steps included in a sequence can be interrupted may be provided in a storage device separated from the inkjet printer, and the inkjet printer determines whether the sequence is interrupted or not by inquiring the storage device for the information regarding the interruption.

In the above-described exemplary embodiment, when the predetermined amount of ink has been suctioned, the purging operation is stopped (S35 of FIG. 8). This may be modified such that the purging operation is stopped when the ink is suctioned for a predetermined time period. It should be noted that, a standard for determining whether the purging operation is stopped can be set by the operator or designer arbitrarily. Even when the maintenance procedure is executed in the normal purge mode, the suctioned amount of the ink or the suctioning time duration may be reduced when the purging operation is stopped, or even when the powered purge mode, the suctioned amount of the ink or the suctioning time period may not be reduced.

According to the embodiment, the inkjet heads 21 are covered with the suction cap 15 one after another when the purging operation is executed. This may be modified such that a plurality of suction caps are provided corresponding to the inkjet heads 21 and all the purging operation can be performed for all the inkjet heads 21 at a time.

In the above-described embodiment, the purging operation is a suction purge operation in which the nozzle surface of each inkjet head 21 is covered with the cap 15 and the ink is suctioned from the ejecting nozzles of the inkjet head 21 using the suction pump. This may be replaced with a discharging system, in which the ink of the nozzles of the inkjet head 21 is discharged therefrom by the pressure generated in the inkjet head 21.

The present disclosure relates to the subject matter contained in Japanese Patent Application No. 2003-341446, filed on Sep. 30, 2003, which is expressly incorporated herein by reference in its entirety.

What is claimed is:

1. An inkjet imaging device, comprising:

a recording head that ejects ink toward a recording medium;

a maintenance system that performs a recovery procedure consisting of a plurality of operations which include (1) a purging operation to remove ink from the recording head and (2) a wiping operation to wipe out the ink adhered on a nozzle surface of the recording head after the purging operation is executed;

a determining system that determines whether a currently executed operation of the recovery procedure can be interrupted when interruption of the currently executed recovery procedure is instructed; and an interrupting system that interrupts the recovery procedure when the determining system determines that the currently executed operation of the recovery procedure can be interrupted.

2. The inkjet imaging device according to claim 1, wherein, when the determining system determines that the currently executed operation cannot be interrupted, the interrupting system allows the recovery procedure to continue until another operation, which can be interrupted, is executed.

3. The inkjet imaging device according to claim 2, wherein the determining system determines any operation from the purging operation to the wiping operation as an operation that cannot be interrupted.

4. The inkjet imaging device according to claim 2, wherein the plurality of operations further includes (3) a flushing operation in which the ink in the recording head is discharged after the wiping operation is executed, and wherein the determining system determines any operation from the purging operation to the flushing operation as an operation that cannot be interrupted.

5. The inkjet imaging device according to claim 2, wherein when the currently executed operation that cannot be interrupted is a predetermined operation, the predetermined operation is executed in a different way in comparison with a case where the interruption of the currently executed recovery procedure is not instructed.

6. The inkjet imaging device according to claim 5, wherein, when the predetermined operation is executed in the different way, a time period necessary for completion of the predetermined operation is reduced.

7. The inkjet imaging device according to claim 5, wherein the predetermined operation is the purging operation.

8. The inkjet imaging device according to claim 7, wherein, when the purging operation is executed in the different way, the purging operation is stopped when a predetermined amount of ink is purged.

9. The inkjet imaging device according to claim 1, wherein the determining system determines whether each of the plurality of operations can be interrupted.

10. The inkjet imaging device according to claim 9, wherein the determining system includes a plurality of flags each indicative of whether an operation can be interrupted, the plurality of flags being assigned to the plurality of operations included in the recovery procedure, respectively.

11. A method of controlling an inkjet imaging device having a recording head that ejects ink toward a recording medium and a maintenance system that performs a recovery procedure consisting of a plurality of operations which include (1) a purging operation to remove ink from the recording head and (2) a wiping operation to wipe out the ink adhered on a nozzle surface of the recording head after the purging operation is executed, the method including the steps of:

determining whether a currently executed operation of the recovery procedure can be interrupted when interruption of the currently executed recovery procedure is instructed; and interrupting the recovery procedure when the determining step determines that the currently executed operation of the recovery procedure can be interrupted.

12. The method according to claim 11, wherein, when the determining step determines that the currently executed operation cannot be interrupted, the interrupting step allows the recovery procedure to continue until another operation, which can be interrupted, is executed.

13. The method according to claim 12, wherein the determining step determines any operation from the purging operation to the wiping operation as an operation that cannot be interrupted.

14. The method according to claim 12, wherein the plurality of operations further includes (3) a flushing operation in which the ink in the recording head is discharged after the wiping operation is executed, and wherein the determining step determines any operation from the purging operation to the flushing operation as an operation that cannot be interrupted.

15. The method according to claim 12, wherein when the currently executed operation that cannot be interrupted is a predetermined operation, the predetermined operation is executed in a different way in comparison with a case where the interruption of the currently executed recovery procedure is not instructed.

16. The method according to claim 11, wherein the determining step determines whether each of the plurality of operations can be interrupted.

17. The method according to claim 16, wherein the determining step determines whether each of the plurality of operations can be interrupted based on a plurality of flags each indicative of whether an operation can be interrupted, the plurality of flags being assigned to the plurality of operations included in the recovery procedure, respectively.

18. A computer program product comprising computer readable instructions causing a computer to control an inkjet imaging device having a recording head that ejects ink toward a recording medium and a maintenance system that performs a recovery procedure consisting of a plurality of operations which include (1) a purging operation to remove ink from the recording head and (2) a wiping operation to wipe out the ink adhered on a nozzle surface of the recording head after the purging operation is executed, the computer program product including the instructions of:

determining whether a currently executed operation of the recovery procedure can be interrupted when interruption of the currently executed recovery procedure is instructed; and interrupting the recovery procedure when the determining step determines that the currently executed operation of the recovery procedure can be interrupted.

19. The computer program product according to claim 18, further including an instruction of continuing the recovery procedure to until another operation, which can be interrupted, is executed.

20. The computer program product according to claim 18, wherein each of the operations from the purging operation to the wiping operation is defined as an operation that cannot be interrupted.

* * * * *